US009258660B2

(12) United States Patent
Zeleznik

(10) Patent No.: US 9,258,660 B2
(45) Date of Patent: Feb. 9, 2016

(54) RESET CIRCUIT FOR MEMS CAPACITIVE MICROPHONES

(71) Applicant: Robert Bosch GmbH, Stuttgart (DE)

(72) Inventor: Matthew A. Zeleznik, Pittsburgh, PA (US)

(73) Assignee: Robert Bosch GmbH, Stuttgart (DE)

( * ) Notice: Subject to any disclaimer, the term of this patent is extended or adjusted under 35 U.S.C. 154(b) by 148 days.

(21) Appl. No.: 14/086,351

(22) Filed: Nov. 21, 2013

(65) Prior Publication Data

US 2014/0270204 A1 Sep. 18, 2014

Related U.S. Application Data

(60) Provisional application No. 61/782,149, filed on Mar. 14, 2013.

(51) Int. Cl.

| | |
|---|---|
| ***H04R 29/00*** | (2006.01) |
| ***H04R 3/00*** | (2006.01) |
| ***H04R 19/01*** | (2006.01) |

(52) U.S. Cl.

CPC ..... *H04R 29/004* (2013.01); *H04R 3/00* (2013.01); *H04R 19/016* (2013.01)

(58) Field of Classification Search

CPC ..... H04R 29/004; H04R 19/016; H04R 3/00; H04R 19/04

USPC ..... 381/58, 111, 113

See application file for complete search history.

(56) References Cited

U.S. PATENT DOCUMENTS

| | | | | |
|---|---|---|---|---|
| 6,266,423 | B1 | 7/2001 | Werrbach | |
| 8,041,056 | B2 | 10/2011 | Kinoshita | |
| 8,134,375 | B2 | 3/2012 | Boom | |
| 8,150,073 | B2 | 4/2012 | Matsumoto et al. | |
| 2006/0008097 | A1 * | 1/2006 | Stenberg et al. | 381/113 |
| 2009/0121778 | A1 | 5/2009 | Ceballos et al. | |
| 2010/0013501 | A1 | 1/2010 | Van Den Boom | |
| 2010/0246859 | A1 | 9/2010 | David et al. | |
| 2011/0142261 | A1 | 6/2011 | Josefsson | |
| 2012/0223770 | A1 | 9/2012 | Muza | |

FOREIGN PATENT DOCUMENTS

| | | |
|---|---|---|
| EP | 1599067 | 11/2005 |
| WO | 2007/132422 | 11/2007 |

OTHER PUBLICATIONS

International Search Report and Written Opinion for Application No. PCT/US2014/025638 dated Jun. 26, 2014 (10 pages).

* cited by examiner

*Primary Examiner* — Paul S Kim
(74) *Attorney, Agent, or Firm* — Michael Best & Friedrich LLP

(57) ABSTRACT

A method of initiating a reset sequence for a MEMS capacitive microphone. The method includes monitoring an output of a microphone and detecting a mute condition in the output of the microphone indicative of a fault condition. The method also includes activating a timing circuit. The timing circuit is configured to indicate when a certain time period since the initiation of the timing circuit has elapsed. Upon expiration of the time period indicated by the timing circuit, a microphone reset sequence is initiated.

18 Claims, 7 Drawing Sheets

RESET CIRCUIT FOR MEMS CAPACITIVE MICROPHONES

RELATED APPLICATIONS

This application claims the benefit of U.S. Provisional Application No. 61/782,149, filed on Mar. 14, 2013, the entire contents of which are incorporated herein by reference.

BACKGROUND

The present invention relates to MEMS capacitive microphones and processing systems for the same. MEMS capacitive microphones operate utilizing conservation of charge. A high impedance switch network, usually consisting of two anti-parallel diodes with a MOS transistor in parallel with the diodes, is used to apply a fixed charge across two plates of a capacitor. When the microphone is initially turned on the MOS transistor is switched on allowing a DC voltage to be put on one plate of the capacitor while the other plate is held at a different electrical potential. When the capacitor is fully charged (typically within 10's of milliseconds) the MOS transistor is switched off and the capacitor is left with a fixed charge across the two plates. When sound pressure waves impinge on the moveable plate of the capacitor, the capacitance changes and, because the charge is fixed across the capacitor, the voltage increases or decreases proportionally to the amount of change in capacitance induced by the incident sound pressure.

SUMMARY

When very large acoustic signals (acoustic overload signals) hit the membrane, they can cause a voltage excursion large enough to push the diodes towards a forward bias in the high impedance (HIZ) network. Once either diode becomes forward biased, charge is lost from the two plates of the capacitor and a new voltage is present across the plates of the capacitor. If this voltage loss is large enough, it can cause problems for the preamplifier that is buffering or amplifying the signal voltage. Depending on the design of the amplifier, the output stage can become current or voltage limited with a large enough input signal, or the common mode range of the amplifier can be exceeded, where both cases will cause the amplifier to fail.

For MEMS microphones with a sense capacitance on the order of 1 pF, the high-impedance network needs to be on the order of 100s of Terra-ohms in order to meet the low noise requirements from the biasing element of the microphone. With a 1 pF sensor and 10 Terra-ohm impedance the RC time constant for the system is 10 seconds. If a large acoustic signal causes a significant voltage excursion at the sense node, then the amplifier can voltage or current limit, preventing the amplifier from processing further acoustic signals while the HIZ network returns to its initial state over possible 10's of seconds, corresponding to the RC time constant of the HIZ. During this time the microphone is perceived to mute since it is no longer reproducing sound.

In one embodiment, the invention provides a microphone system that includes a capacitive microphone diaphragm and a pre-amplifier for outputting a signal indicative of acoustic pressure (i.e., sound) on the microphone diaphragm. A comparator is configured to monitor the output of the pre-amplifier, and to detect a mute condition in the pre-amplifier output that is indicative of a fault condition. The system also includes a timing circuit. The timing circuit is configured to receive input from the comparator when the mute condition is detected and monitor the duration of the mute condition. When the duration of the mute condition exceeds a defined reset threshold (i.e., a certain period of time), a microphone reset sequence is initiated.

The system allows for acoustic overload signals to be processed while present, but would trigger a power on reset for the HIZ network/module if the amplifier becomes voltage or current limited for a given amount of time. The comparator is used to detect whether the amplifier is voltage or current limited. With the introduction of a circuit block with a large time constant that can be reset, the output of the comparator can be used to allow the timing block to run while the microphone is muted. If the microphone comes out of a mute condition, the comparator would no longer detect the mute condition and the timing block would be reset. During acoustic overload signals, the timing block would be periodically reset as the amplifier rails out or current limits and then comes back into operation. With the periodic reset of the timing block it will not run long enough for its long time constant to trigger a reset signal to the HIZ network/module. If the amplifier gets stuck in a voltage or current limited state (e.g., when the diode(s) has become forward biased), then the timing block will run until its long time constant triggers a reset signal for the HIZ network/module. In this system, the time constant of the timing circuit has to be set so that it is longer than a minimum frequency periodic signal which should be processed. In most applications where one would want to have a low frequency corner less than 100 Hz this would require the time constant for the reset circuit to be over 10 milliseconds.

In another embodiment, the invention provides a method of initiating a reset sequence for a MEMS capacitive microphone. The method includes monitoring an output of a microphone and detecting a mute condition in the output of the microphone indicative of a fault condition. The method also includes activating a timing circuit. The timing circuit is configured to indicate when a certain time period since the initiation of the timing circuit has elapsed. Upon expiration of the time period indicated by the timing circuit, a microphone reset sequence is initiated.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
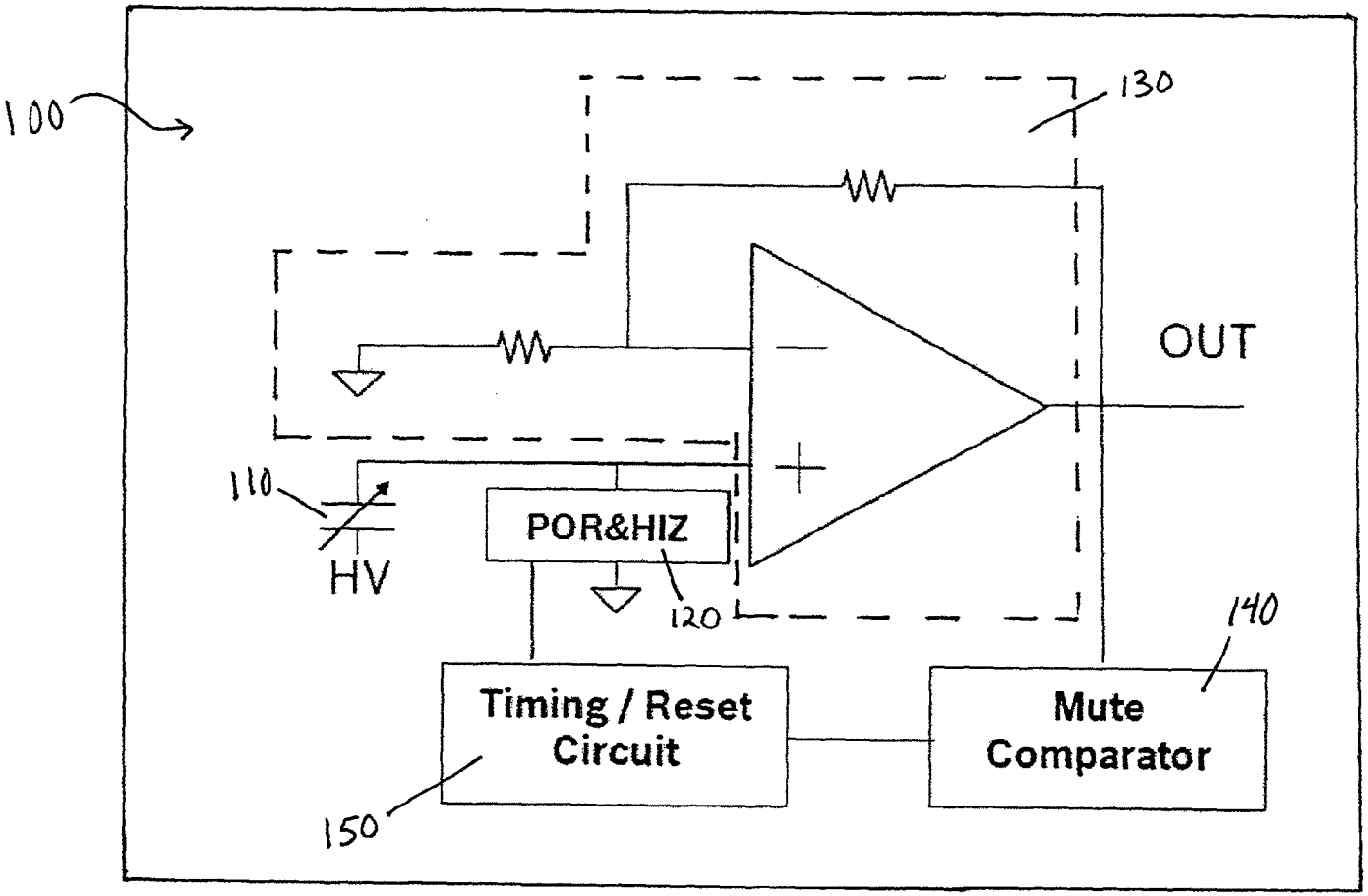
FIG. 1 is a block diagram of a reset circuit for a MEMS capacitive microphone.

FIG. 1 is a block diagram of a MEMS capacitive microphone system 100. The microphone system 100 includes a capacitive microphone sensor 110, a HIZ network/power-on reset module 120, an amplifier 130, a comparator 140, and a timing circuit 150. The comparator 140 detects any mute conditions on the output of the amplifier 130 and feeds the timing circuit 150 with a logic signal when a mute condition is detected. The timing circuit 150 outputs a power-on-reset signal to the HIZ/POR module 120 when the mute comparator has indicated a mute condition for a defined period of time.

Figure 2:
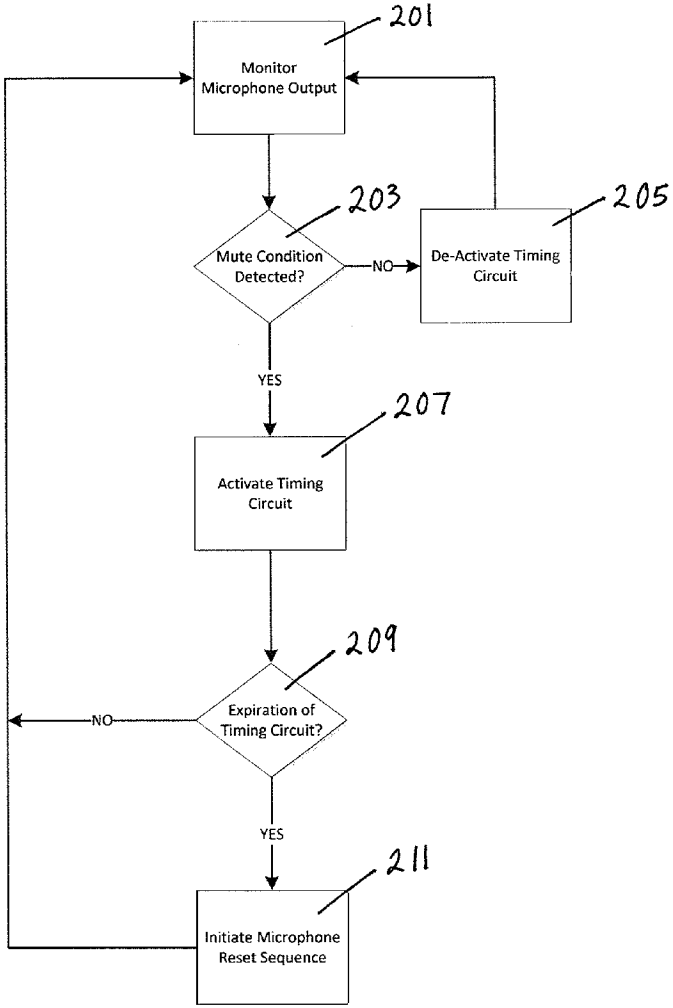
FIG. 2 is a flowchart of a method for initiating a reset sequence for a MEMS capacitive microphone having the reset circuit of FIG. 1.

FIG. 2 illustrates a method of initiating a power-on reset when a mute condition is detected. When the microphone is powered on, the mute comparator 140 monitors the output of the amplifier 130 (step 201) and determines whether a mute condition arising from an acoustic overload signal is present (step 203). As long as no mute condition is detected, the output of the comparator 140 keeps the timing circuit 150 in a deactivated state (step 205).

When the mute comparator 140 detects the mute condition 313, it sends a logic signal to the timing circuit 150 to activate the timing circuit 150 (step 207). The timing circuit 150 then runs until expiration or until the mute condition is removed. Upon expiration of a defined period of time (step 209), the timing circuit 150 provides a POR enable signal to the HIZ/POR module 120. In response to receiving the POR enable signal, the HIZ/POR module 120 initiates a new power-on-reset sequence (step 211).

Figure 3:
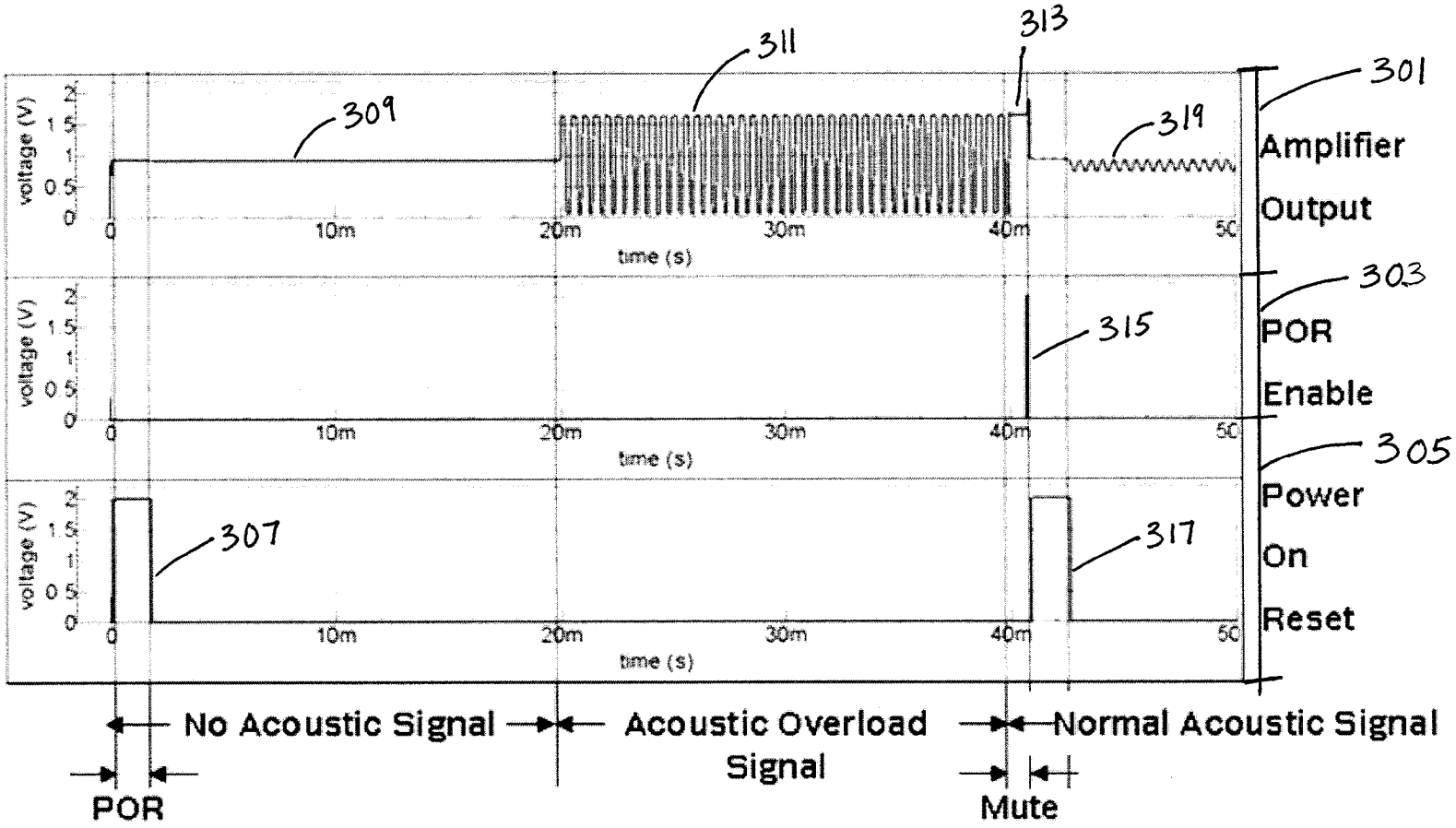
FIG. 3 is a graph of the waveforms generated by a MEMS capacitive microphone including the reset circuit of FIG. 1.

FIG. 3 provides a series of timing diagrams that illustrate and example of the operation of the microphone system 100 according to the method of FIG. 2. FIG. 3 shows the time-based signals of the amplifier output 301 and the power-on-enable output 303 (provided from the timing circuit 150 to the HIZ/POR module 120). FIG. 3 also illustrates the time 305 during which the power-on reset sequence is active by the HIZ/POR module 120. When the microphone is first powered on at 0 ms, an initial power-on-reset (POR) 307 is performed by the HIZ/POR module 120. As such, the power-on-reset output 305 illustrated in FIG. 3 is high from 0 to 2 ms. There is no acoustic stimulus applied to the microphone system from 2 ms until 20 ms. Therefore, the amplifier output from 2 ms to 20 ms remains at its biased baseline output (i.e., 1V) as indicated by reference numeral 309. As long as no mute condition is detected, the timing circuit 150 remains inactive as shown in timing diagram 303 from 0 ms to 41 ms.

However, as indicated in timing diagram 301, an acoustic overload is applied to the microphone system from 20 ms to ~40 ms and, as a result, the amplifier output is current limited at the peaks and voltage limited (at 0V) at the troughs of the output signal (shown as 311 in timing diagram 301). When the acoustic overload is removed at ~40 ms, the amplifier output exhibits a large DC offset which prevents it from processing a signal. Hence, a mute condition 313 is present on the amplifier output from ~40 ms to 41 ms. When the mute condition 313 has been present for a defined period of time (e.g., ~1 ms), the timing circuit 150 provides a POR enable signal 315 to the HIZ/POR module 120. In response to the POR enable signal 315, the HIZ/POR module 120 initiates another power-on reset sequence 317 from ~41 ms to ~42 ms. After the power-on-reset sequence 317 is performed, the amplifier produces a normal output 319 in response to acoustic pressures that do not produce an acoustic overload condition.

Figure 4:
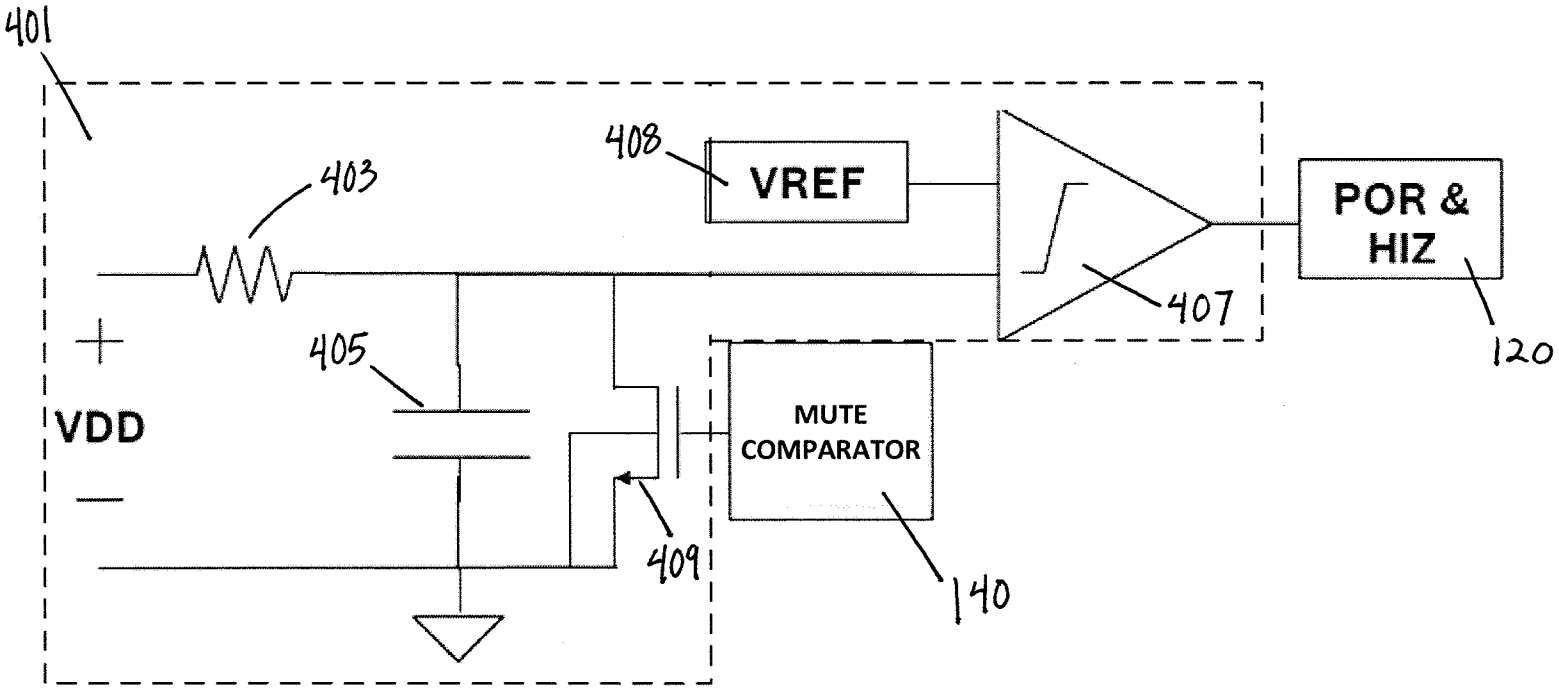
FIG. 4 is a block diagram of an RC timing circuit for a MEMS capacitive microphone.

FIG. 4 shows one embodiment of a timing circuit 401 that can be implemented as the timing circuit in the microphone system 100 of FIG. 1. The time constant for the timing circuit 401 is set by the resistor 403 and the capacitor 405. The voltage on the capacitor 405 is provided to a comparator 407 where it is compared to a reference voltage 408. When the amplifier 130 is in normal operation (i.e., no mute condition present), the output of the mute comparator 140 is held high which, in turn, holds a switch 409 in a closed position creating a short circuit between the terminals of the capacitor 405. In this state, the comparator 407 determines that voltage on the capacitor 405 is less than the reference voltage 408 and produces a low "POR Enable" output to the HIZ/POR module 120.

However, when the amplifier mute comparator 140 detects a mute condition, the output of the mute comparator 140 goes low, causing the switch 409 to open. When the switch is opened and the short circuit is removed, the capacitor 405 begins to charge and the voltage on the capacitor 405 begins to exponentially rise. When the voltage on the capacitor 405 surpasses the reference voltage 408, the output of the comparator 140 switches to high, sending an "POR Enable" signal to the HIZ/POR module 120 and initiating a power-on-reset sequence.

Figure 5:
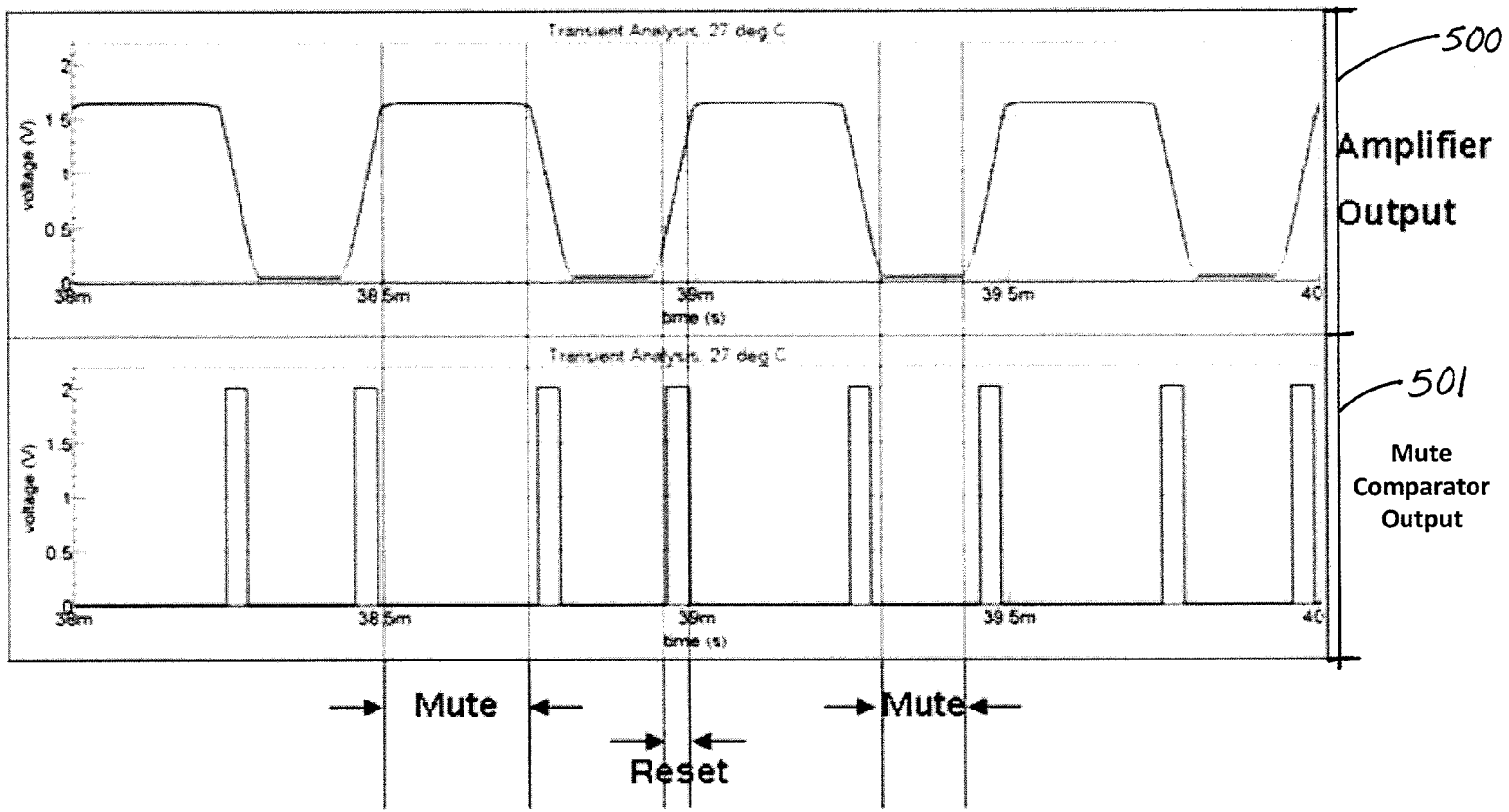
FIG. 5 is a graph of the output of the amplifier and the "AMP COMP OUT" component of the circuit of FIG. 3.

As discussed above, the mute comparator provides "high" output signal whenever a "non-limited" output signal is detected from the amplifier. As such, in the presence of an acoustic overload signal with positive and negative edges (as shown by the amplifier output waveform 500 of FIG. 5), the mute comparator output 407 will toggle between high and low (as shown by the mute comparator output waveform 501). This toggling between high and low causes the timing circuit 150 to be periodically reset. When the amplifier 130 is in a normal operating region the output of the mute comparator will be high, thus disabling the timing circuit 150. When the amplifier 130 is either voltage or current limited, the output of the mute comparator will be low, enabling the timing circuit 150. However, because the timing circuit requires that the output of the mute comparator be held low (indicating a mute condition) for a defined period of time before the POR Enable signal is generated, the sporadic voltage and current limiting caused by an acoustic overload does not trigger a power-on reset until the acoustic overload affects the charge on the capacitor (i.e., forward bias) resulting in a sustained mute condition.

Figure 6:
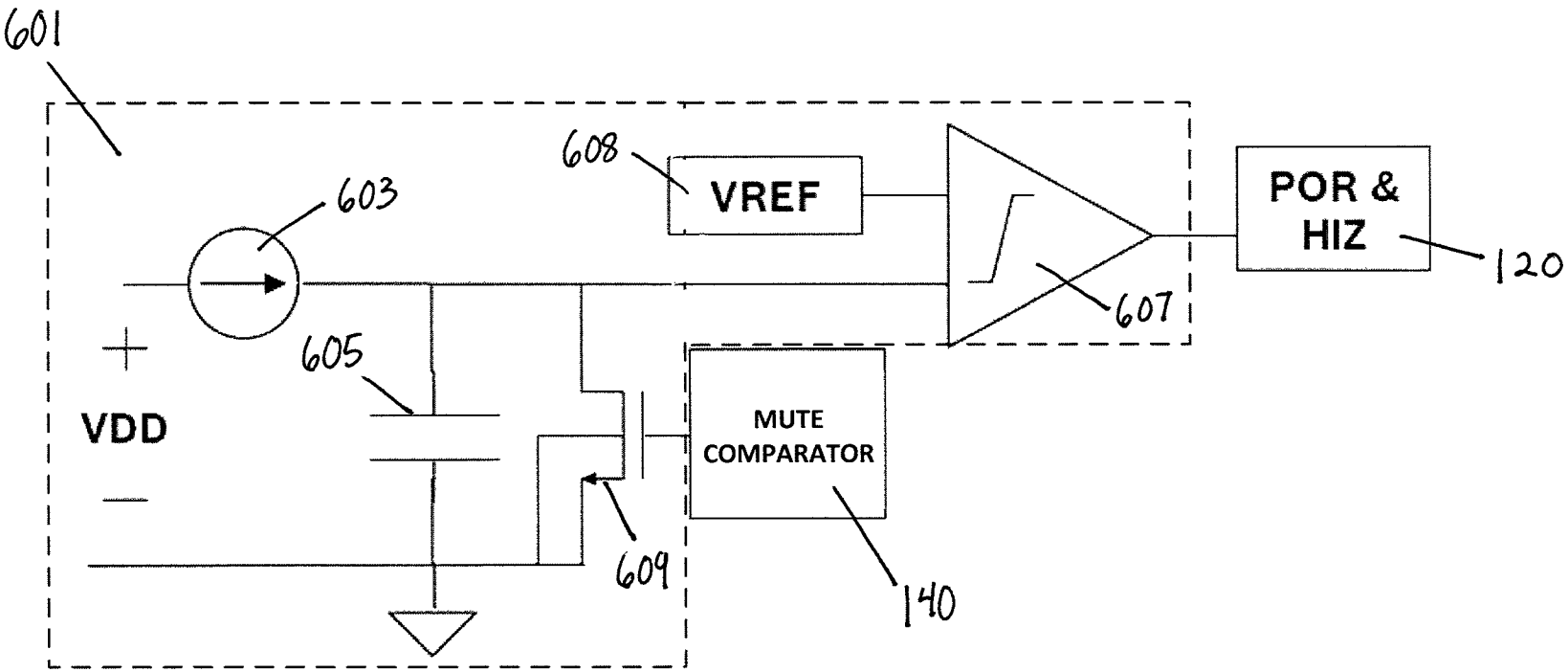
FIG. 6 is a block diagram of a timing circuit including a current onto capacitor configuration.

FIG. 6 shows another embodiment of a timing circuit 601. In this example, the timing circuit 601 is current controlled such that the time constant of the timing circuit 601 is set by the current 603 flowing onto the capacitor 605. Like the example of FIG. 4, the voltage on the capacitor 605 is provided to a comparator 607 where it is compared to a reference voltage 608. When the output of the mute comparator 140 is high (indicating a normal amplifier output), a switch 609 is closed and creates a short-circuit between the terminals of the capacitor 605. However, when the output of the mute comparator 140 goes low (indicating a mute condition), the switch 609 is opened and the constant current applied by the current controlled circuit 603 causes a linear increase in the voltage on the capacitor 605. Once the voltage on the capacitor 605 exceeds the reference voltage 408, the comparator 607 provides the POR Enable signal to the HIZ/POR module 120.

Figure 7:
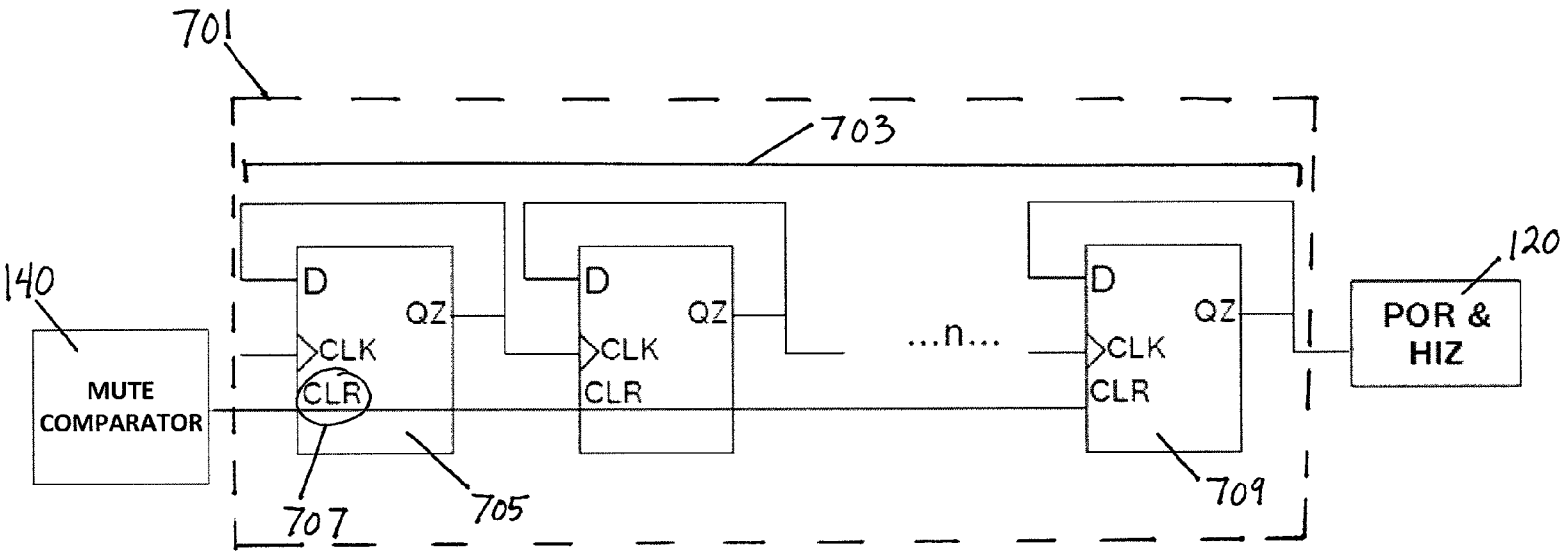
FIG. 7 is a block diagram of a timing circuit including a D flip-flop clock divider.

FIG. 7 illustrates yet another embodiment of a timing circuit 701. In this example, the time constant is set by a clock divider 703 implemented with a series of D flip-flops 705—more specifically, the time constant for this construction is set by the timing of a master clock for the timing circuit and the number of clock divisions (n) (i.e., the number of D flip-flops included in the series of D flip-flops). When the amplifier 130 is in normal operation, the output of the mute comparator 140 is high and a clear signal 707 is applied to the D flip flops 705. The clear signal prevents the D flip-flops in the clock divider 703 from changing state. As such, in this state, the clock divider 703 does not operate and does not send a logic signal to the HIZ/POR module 120 enabling a power-on-reset.

However, when the mute comparator 140 detects a mute condition, the output goes low and the clock divider 703 begins to divide. On the first clock cycle, the output of the first D-flip flop 705 changes state. Because this output is coupled to the next D flip-flop, the output of the next D flip-flop changes state on the next clock cycle. As long as the output of the mute comparator 140 remains low, each clock cycles causes another subsequent D flip-flop in the series of D flip-flops to change state until the final flip-flop 709 in the divider toggles and sends the POR Enable signal to the HIZ/POR module 120 enabling a power-on-reset.

In the presence of an acoustic overload signal with positive and negative edges, the output of the mute comparator 140 will be nominally high. However, it will go low when the amplifier 130 either voltage or current limits at the peak of the acoustic signal. If the acoustic waveform transitions and causes the amplifier 130 to limit in the other direction, the transition will cause the mute comparator's 140 output to briefly go high in the transition region, therefore resetting each D flip-flop in the clock divider 703.

Thus, the invention provides, among other things, a system and method for allowing acoustic overload signals to be reproduced and to reset the microphone if a mute condition is detected. Various features and advantages of the invention are further illustrated in the attached figures.

What is claimed is:

1. A method of initiating a reset sequence, the method comprising:

monitoring an output of a microphone for operational degradation due to an acoustic overload;

detecting a mute condition in the output of the microphone after the acoustic overload is removed from the microphone, the mute condition being indicative of a fault condition;

activating a timing circuit when the mute condition is detected, the timing circuit configured to indicate when a time period has elapsed since the timing circuit is initiated; and, initiating a microphone reset sequence upon expiration of the time period indicated by the timing circuit.

2. The method of claim 1, wherein the acoustic overload includes a high frequency acoustic pressure.

3. The method of claim 1, wherein the operational degradation includes an alteration of the charge applied to a capacitive microphone caused by the acoustic overload being applied to the capacitive microphone for a period of time.

4. The method of claim 1, wherein monitoring the output of the microphone includes monitoring an output of a microphone pre-amplifier.

5. The method of claim 1, further comprising deactivating the timing circuit when the mute condition is removed before expiration of the time period.

6. The method of claim 1, wherein activating the timing circuit includes changing a state of a switch from a first state to a second state, the timing circuit being configured to charge a capacitor when the switch is in the second state, and wherein the timing circuit indicates that the time period has elapsed when the charge of the capacitor exceeds a reference charge.

7. The method of claim 6, wherein changing the state of the switch from the first state to the second state includes changing the switch from a closed state to an open state.

8. The method of claim 6, wherein a duration of the time period is defined at least in part by a resistance of the timing circuit and a capacitance of the capacitor.

9. The method of claim 6, further comprising deactivating the timing circuit when the mute condition is removed before the expiration of the time period, wherein deactivating the timing circuit includes changing the state of the switch from the second state to the first state.

10. The method of claim 1, wherein activating the timing circuit includes initiating a clock divider, wherein the duration of the time period is defined at least in part by the number of clock divisions of the clock divider.

11. The method of claim 1, wherein activating the timing circuit includes changing an input to a first D-flip-flop of a plurality of D-flip-flops arranged in series, wherein an output of the first D-flip-flop is coupled to an input of a second D-flip-flop such that, when the output of the first D-flip-flop changes in a first clock cycle, the output of the second D-flip-flop changes in a second clock cycle in response to the change in the output of the first D-flip-flop.

12. The method of claim 11, wherein the duration of the time period is defined at least in part by the number of D-flip-flops arranged in series in the timing circuit.

13. The method of claim 11, further comprising deactivating the timing circuit when the mute condition is removed before the expiration of the time period, wherein deactivating the timing circuit includes applying a clear signal to each of the plurality of D-flip-flops arranges in series in the timing circuit.

14. A microphone system comprising:

a capacitive microphone diaphragm;

a pre-amplifier configured to output a signal indicative of acoustic pressures on the microphone diaphragm;

a comparator configured to monitor the output of the pre-amplifier for operational degradation due to an acoustic overload and to detect a mute condition indicative of a fault condition after the acoustic overload is removed; and a timing circuit configured to receive an input from the comparator when the mute condition is detected, monitor a duration of time of the mute condition, and initiate a microphone reset sequence when the duration of time exceeds a defined reset threshold.

15. The system of claim 14, wherein the timing circuit includes a switch and a capacitor arranged such that, when the switch is opened, the capacitor charges, wherein the timing circuit is configured to open the switch in response to the input from the comparator indicating that the mute condition is detected, initiate a microphone reset sequence when the duration of time exceeds a defined reset threshold by initiating the microphone reset sequence when the charge on the capacitor of the timing circuit exceeds a reference charge, and close the switch in response to an input from the comparator indicating that the mute condition is not detected, wherein the charge on the capacitor dissipates when the switch is closed.

16. The system of claim 14, wherein the timing circuit includes a clock divider and wherein the duration of time is defined at least in part by a number of clock divisions of the clock divider.

17. The system of claim 14, wherein the timing circuit includes a plurality of D-flip-flops arranged in series, wherein an output of the first D-flip-flop is coupled to an input of a second D-flip-flop such that, when the output of the first D-flip-flop changes in a first clock cycle, the output of the second D-flip-flop changes in a second clock cycle in response to the change in the output of the first D-flip-flop, and wherein the timing circuit is configured to change an input to the first D-flip-flop in response to the input from the comparator indicating that the mute condition is detected, initiate a microphone reset sequence when the duration of time exceeds the defined reset threshold by initiating the microphone reset sequence when the output of a last D-flip-flop of the plurality of D-flip-flops arranged in series changes, wherein the duration of the time is defined at least in part by the number of D-flip-flops arranged in series between the first D-flip-flop and the last D-flip-flop, and apply a clear signal to each D-flip-flop of the plurality of D-flip-flops arranged in series in response to an input from the comparator indicating that the mute condition is not detected.

18. The system of claim 14, wherein a charge is applied to the capacitive microphone diaphragm such that acoustic pressures applied to the microphone diaphragm cause a measurable change in a capacitance of the capacitive microphone diaphragm, and wherein an acoustic overload applied to the capacitive microphone diaphragm for a period of time causes a change in the charge applied to the capacitive microphone, and wherein the mute condition is indicative of the change in the charge applied to the capacitive microphone after the acoustic overload is removed.

* * * * *